US009601232B2

(12) United States Patent
Hayes

(10) Patent No.: US 9,601,232 B2
(45) Date of Patent: Mar. 21, 2017

(54) BATTERY CABLE INSULATOR

(71) Applicant: Rhody Hayes, Pasco, WA (US)

(72) Inventor: Rhody Hayes, Pasco, WA (US)

( * ) Notice: Subject to any disclaimer, the term of this patent is extended or adjusted under 35 U.S.C. 154(b) by 212 days.

(21) Appl. No.: 14/177,059

(22) Filed: Feb. 10, 2014

(65) Prior Publication Data

US 2015/0228383 A1 Aug. 13, 2015

(51) Int. Cl.

| | |
|---|---|
| ***H01B 17/00*** | (2006.01) |
| ***H01B 3/30*** | (2006.01) |
| ***H01B 3/28*** | (2006.01) |
| ***H01B 3/44*** | (2006.01) |
| ***H01R 4/22*** | (2006.01) |

(52) U.S. Cl.
CPC ..... *H01B 3/30* (2013.01); *H01B 3/28* (2013.01); *H01B 3/441* (2013.01); *H01R 4/22* (2013.01); *H01R 2201/26* (2013.01)

(58) Field of Classification Search
CPC ..... H01R 4/70; H01R 4/22; H01R 11/284; H01R 2201/26; H02G 15/18; H01B 17/58; H01B 3/30; H01B 3/28; H01B 3/441
USPC ..... 174/138 F
See application file for complete search history.

(56) References Cited

U.S. PATENT DOCUMENTS

| | | | | | |
|---|---|---|---|---|---|
| 2,571,771 | A * | 10/1951 | Sigman | H01R 4/22 | 174/138 F |
| 5,346,408 | A * | 9/1994 | Chupak | H01R 11/284 | 174/138 F |
| 2001/0053636 | A1* | 12/2001 | Tamai | H01R 11/282 | 439/677 |
| 2012/0315532 | A1* | 12/2012 | Andersen | H01M 2/20 | 429/175 |

* cited by examiner

*Primary Examiner* — Pete Lee

(57) ABSTRACT

The Battery Cable Insulator (100) is a plastic sleeve (120) into which a battery cable lug is removably inserted. The plastic sleeve (120) is formed of an electrical insulating plastic having a sleeve opening (140).

2 Claims, 1 Drawing Sheet

BATTERY CABLE INSULATOR

FIELD OF THE INVENTION

This invention relates to the insulation of exposed electrical wire and connectors. More specifically this invention relates to the electrical insulation of electrically energized cable connectors including disconnected battery cable lugs.

BACKGROUND OF THE INVENTION

Work with electrical and electronic circuits frequently require exposure of electrically energized connectors including battery lugs. A traditional method of managing exposed and disconnected lugs is to place then at a distance from the workspace or to temporarily insulate the disconnected lug with electricians tape.

SUMMARY OF THE INVENTION

The Battery Cable Insulator (100) is a sleeve (120) comprising a right open oblong cylindrical container into which a battery cable lug can be removably inserted, through a sleeve opening (150), and electrically insulated.

BRIEF DESCRIPTION OF THE FIGURES

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION OF THE INVENTION

Figure 1:
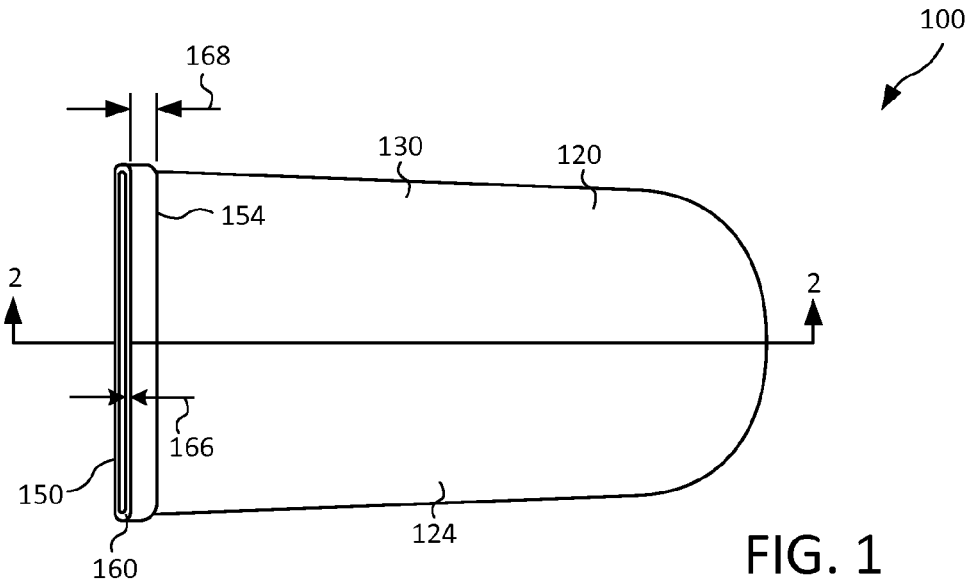
FIG. 1 illustrates the Battery Cable Insulator (100) showing a sleeve (120) formed of plastic (124). Seen is a first side (130) and a second side (140) and at least one sleeve opening (150) having a sleeve opening circumference (154) with a sleeve opening rim (160) formed at the sleeve opening circumference (154). The sleeve opening rim (160) has a sleeve opening rim thickness (166) and a sleeve opening rim width (168).
Figure 2:
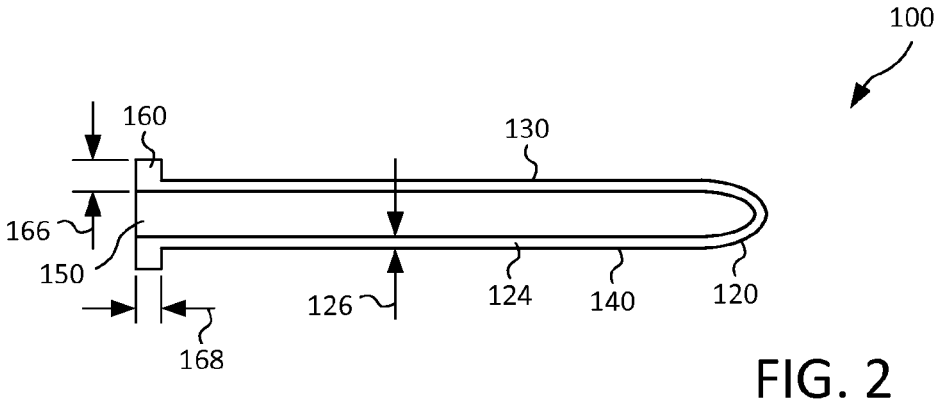
FIG. 2 is a section 2-2 from FIG. 1 showing the Battery Cable Insulator (100), a sleeve (120) formed of plastic (124) having a generally uniform sleeve thickness (126). Seen is a first side (130) and a second side (140) and at least one sleeve opening (150) having a sleeve opening circumference (154) with a sleeve opening rim (160) formed at the sleeve opening circumference (154). The sleeve opening rim (160) has a sleeve opening rim thickness (166) and a sleeve opening rim width (168).

The patents and publications referred to herein are provided herewith in an Information Disclosure Statement in accordance with 37 CFR 1.97.

The Battery Cable Insulator (100) is a sleeve (120) forming a right open oblong cylindrical container. A right open oblong cylindrical container has at least one opening and is otherwise closed. In the preferred embodiment there is one opening. The sleeve (120) has at least one sleeve opening (150). In the preferred embodiment the at least one sleeve opening (150) is one sleeve opening (150). While more than one sleeve opening (150) may be desired in certain circumstances, the existence of more than one sleeve opening (150) will provide the unwanted opportunity for the connector or lug inserted into a sleeve opening (150) to extend out of sleeve (120) through another opening and thereby come in contact with a structure creating an electrical short. Another unwanted opportunity would be for more than one cable lug or wire or connector to be inserted into a single sleeve (120) providing the opportunity for the different lugs to come into contact creating unwanted electrical interconnection.

The plastic sleeve (120) is formed of an electrical insulating material including plastic (124). The electrical insulating material used for the said sleeve (120) will be recognized by those of ordinary skills in the electrical insulating arts to include many materials including, but not limited to, linear low-density polyethylene elastomer (LLDPE). The plastic sleeve (120) is of a generally uniform sleeve thickness (126). The sleeve (120) has a first side (130) and a second side (140). The sleeve (120) exhibits a form memory function resulting from the properties of the material used to form the sleeve (120) and or from the sleeve form resulting from the plastic injection molding process of forming the said sleeve (120). A contributing factor to the form memory function is created by the dimension relationship between the thickness of the first side (130) and the second side (140) relative to the dimensions of the sleeve opening rim thickness (166) and the sleeve opening rim width (168). Where the sleeve opening rim thickness (166) and or the sleeve opening rim width (168) is about 30% greater than the thickness of the first side (130) or the second side (140) there is a greater sense of form memory in returning the structure to a form close to that of the device prior to the insertion of a batter lug or other electrically hot wire or connector into the device via the sleeve opening (150).

The form memory function generally retains or returns the said sleeve (120) to a generally flat form causing resulting in the said first side (130) and the said second side (140) to be in close proximity including touching.

The at least one sleeve opening (150) has a sleeve opening circumference (154) with a sleeve opening rim (160) formed at the sleeve opening circumference (154). The sleeve opening rim (160) has a sleeve opening rim thickness (166) and a sleeve opening rim width (168). One or both of the said sleeve opening rim thickness (166) and the said sleeve opening rim width (168) are greater than the sleeve thickness (126). Following insertion of a battery cable and lug through the sleeve opening (120) the form memory function of the sleeve (120) causes the sleeve (120), the sleeve opening (140) and the sleeve opening rim (160) to return to a generally flat form encompassing the inserted battery cable and lug with a retaining force from the plastic memory and from a friction force created by the battery cable and lug contact with the sleeve (120), the sleeve opening (140) and the sleeve opening rim (160) bearing against the inserted lug.

The invention claimed is:

1. A Battery Cable Insulator (100) comprising: a sleeve (120) having at least one sleeve opening (150); the said sleeve (120) is formed of a flexible electrical insulating material (124); and the said sleeve (120) has a first side (130) and a second side (140); the said sleeve (120) generally retains a flat form causing resulting in the said first side (130) and the said second side (140) to be in close proximity including touching; and the said at least one sleeve opening (150) has a sleeve opening circumference (154) with a sleeve opening rim (160) formed at the sleeve opening circumference (154) wherein the at least one sleeve opening (150) is one sleeve opening (150); the electrical insulating material used for the said sleeve (120) is low-density polyethylene elastomer (LLDPE); and the said sleeve (120) is of a generally uniform sleeve thickness (126); and the sleeve (120) exhibits a form memory function retaining the said sleeve (120) in a generally flat form; and the sleeve opening rim (160) has a sleeve opening rim thickness (166) and a sleeve opening rim width (168); the said sleeve opening rim thickness (166) and the sleeve opening rim width (168) are greater in dimension than the said sleeve thickness (126); and the form memory function of the sleeve (120) and the sleeve opening rim (160) and a friction force between the battery cable and lug contact with the sleeve (120), the sleeve opening (140) and the sleeve opening rim (160) bearing against and removably retains an inserted battery cable and lug.

2. A Battery Cable Insulator (100) comprising: a sleeve (120), comprising a generally right open oblong cylindrical container formed of a flexible electrical insulating material (124); and the said sleeve (120) has a first side (130) and a second side (140); the said sleeve (120) generally retains a flat form with the said first side (130) in close proximity to the said second side (140) including touching; and at least one sleeve opening (150) is sized to receive an electrical connector including a battery lug; the said at least one sleeve opening (150) having a sleeve opening circumference (154); a sleeve opening rim (160) formed at the sleeve opening circumference (154); and the said sleeve (120) has a generally uniform sleeve thickness (126); the said sleeve opening rim (160) has a sleeve opening rim thickness (166) and a sleeve opening rim width (168) wherein the at least one sleeve opening (150) is one sleeve opening (150); the electrical insulating material used for the said sleeve (120) is low-density polyethylene elastomer (LLDPE); and the said sleeve (120) is of a generally uniform sleeve thickness (126); and the sleeve (120) exhibits a form memory function retaining the said sleeve (120) in a generally flat form; and the sleeve opening rim (160) has a sleeve opening rim thickness (166) and a sleeve opening rim width (168); the said sleeve opening rim thickness (166) and the sleeve opening rim width (168) are greater in dimension than the said sleeve thickness (126); and the form memory function of the sleeve (120) and the sleeve opening rim (160) and a friction force between the battery cable and lug contact with the sleeve (120), the sleeve opening (140) and the sleeve opening rim (160) bearing against and removably retains an Inserted battery cable and lug.

* * * * *